US007171823B2

(12) United States Patent
Chin et al.

(10) Patent No.: US 7,171,823 B2
(45) **Date of Patent: *Feb. 6, 2007**

(54) AIR CONDITIONER

(75) Inventors: Sim Won Chin, Gwangmyeng-si (KR); Moon Kee Chung, Seoul (KR)

(73) Assignee: LG Electronics Inc., Seoul (KR)

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 93 days.

(21) Appl. No.: 10/836,273

(22) Filed: May 3, 2004

(65) Prior Publication Data

US 2005/0044877 A1 Mar. 3, 2005

(30) Foreign Application Priority Data

Aug. 29, 2003 (KR) ..... 10-2003-0060307

(51) Int. Cl.
*F25D 17/06* (2006.01)

(52) U.S. Cl. ..... 62/419

(58) Field of Classification Search ..... 62/259.1, 62/262, 263, 419

See application file for complete search history.

(56) References Cited

U.S. PATENT DOCUMENTS

| | | | | |
|---|---|---|---|---|
| 2,934,324 | A * | 4/1960 | Partington | 165/296 |
| 3,018,642 | A * | 1/1962 | Lathrop | 62/427 |
| 4,013,120 | A * | 3/1977 | Rheinheimer | 165/48.1 |
| 4,458,502 | A | 7/1984 | Adachi et al. | |
| 5,181,392 | A * | 1/1993 | Itoh et al. | 62/160 |
| 5,921,099 | A | 7/1999 | Lee | |
| 2002/0189274 | A1 | 12/2002 | Lee et al. | |

FOREIGN PATENT DOCUMENTS

| | | |
|---|---|---|
| EP | 1041351 | 9/2004 |
| GB | 2155616 | 9/1985 |
| KR | 10 0300594 | 7/2002 |
| WO | 02/103250 | 12/2002 |

* cited by examiner

*Primary Examiner*—Melvin Jones
(74) *Attorney, Agent, or Firm*—Greenblum & Bernstein, P.L.C.

(57) ABSTRACT

Disclosed is an indoor unit of an air conditioner, in which at least one air inlet is formed at part of or entire bottom surface the indoor unit and an evaporator is installed between the air inlets and a blowing fan so that indoor air sucked in through air inlets passes through the evaporator and is discharged from an outlet vent formed at the front surface of the indoor unit by the operation of a blowing fan. The indoor unit of the air conditioner includes air inlets, an evaporator, a blowing fan, and an outlet vent, wherein the air inlets are formed in an opposite direction of the outlet vent for discharging cooled air; the air inlets are formed on the bottom surface of the indoor unit; indoor air flown into the indoor unit passes through the evaporator and the blowing fan and is discharge from the outlet vent; and air path from the air inlets en route to the outlet vent via the evaporator and the blowing fan is not overlapped.

16 Claims, 21 Drawing Sheets

AIR CONDITIONER

BACKGROUND OF THE INVENTION

1. Field of the Invention

The present invention relates to an air path inside an indoor unit (air handler) of an air conditioner. More specifically, the present invention relates to an indoor unit of an air conditioner, in which at least one air inlet is formed at part or entire bottom surface of the indoor unit and an evaporator is installed between the air inlets and a blowing fan so that indoor air sucked in through air inlets passes through the evaporator and is discharged from an outlet vent formed at the front surface of the indoor unit by the operation of a blowing fan.

2. Discussion of the Background Art

FIG. 1 is a schematic diagram of a related art air conditioner.

Referring to FIG. 1, the related art air conditioner includes an outdoor unit (the condensing unit) 10 disposed outside of a building for heat exchange with outdoor air, an indoor unit (the air handler) 20 disposed inside of a building for circulating and delivering the cooled air, and a series of connecting duct 30 for connecting the outdoor unit 10 to the indoor unit 20.

To be more specific, the outdoor unit 10 pumps low-temperature, low-pressure vaporized refrigerant from the indoor unit 20, compresses it, and liquefies it to low-temperature, low-pressure refrigerant. The outdoor unit 10 includes a compressor 11, a condenser 12, and an expansion valve 13.

The compressor 11 changes the low-temperature, low-pressure vaporized refrigerant from the indoor unit 20 to high-temperature, high-pressure vaporized refrigerant The condenser 12 changes the high-temperature, high-pressure vaporized refrigerant to mid-temperature, high-pressure liquefied refrigerant. The expansion valve 13 changes the mid-temperature, high-pressure liquefied refrigerant to low-temperature, low-pressure liquefied refrigerant.

Among these components, the condenser 12 is the one that is directly involved in heat exchange with outdoor air. Thus, it has a separate fan 12*a* for blowing air from outside.

On the other hand, the indoor unit 20 changes low-temperature, low-pressure liquefied refrigerant from the outdoor unit 10 to low-temperature, low-pressure vaporized refrigerant and as a result thereof, the indoor temperature goes down. Thus, the indoor unit 20 includes an evaporator coil 21, and a fan 21*a*.

The connecting duct 30 connects the outdoor unit 10 to the indoor unit 20, and allows the refrigerant to flow therein. Its position is determined depending on the distance between the outdoor unit 10 and the indoor unit 20.

As explained above, the air conditioner in general has a built-in refrigeration cycle that includes a compressor, a condenser, a capillary expansion valve, and an evaporator coil as a heat exchanger. When the temperature outside begins to climb, the air conditioner provides the cool comfort of indoor air conditioning by controlling the amount of cool air generated by the evaporator coil and hot air generated in the condenser.

Air conditioners are classified into two types: window air conditioners that implements the refrigeration cycle in a body and is small enough to fit into a window frame, and split air conditioners that allows the indoor unit (air handler) to be installed in a different location from the outdoor unit (the condenser). Especially the split air conditioners, depending on where the air conditioner is installed, are divided into wall-mounted split air conditioners, floor standing split air conditioners (including package air conditioners), ceiling-mounted split air conditioners, and ceiling cassette split air conditioners. Particularly, portable indoor units that can be placed on the wall, the floor or the ceiling at users' convenience are called convertible indoor units.

In short, the outdoor unit includes a noise generating compressor, a condenser, and a cooling fan, and the indoor unit includes an evaporator coil and a blowing fan.

Now referring to FIGS. 2 and 3, an indoor unit 1 of an air conditioner includes a rectangular shaped case 10; air inlets 12 formed at the center of the front surface of the case 10 for sucking up indoor air; a blowing fan 14 installed inside the case 10 and guiding the indoor air to the air inlet 12 through rotation; an evaporator coil 16 installed between the indoor air inlet 12 and the blowing fan 14, and generating cooled air by performing heat change between a refrigerant and the indoor air that is flown in the case 10 by the blowing fan 14; and an outlet vent formed on the edge of the front surface of the case 10 or on the upper/lower part of the case 10 to discharge the cooled air formed by the operation the evaporator coil 16 back to the indoor through the operation of the blowing fan 14.

The operational process of the related art indoor unit is now described below.

Low-temperature, low-pressure liquid expanded refrigerant from the outdoor unit (10 in FIG. 1) flows in the evaporator coil 16 inside the indoor unit (1 in FIG. 2), and at the same time, the indoor air flows in the indoor unit 1 through the air inlet 12 formed at the center of the front surface of the indoor unit 1 by the rotation of the blowing fan 14. Then the indoor air is cooled through heat change with the refrigerant traveling in the pipe of the evaporator coil 16, and by the operation of the blowing fan 14 the cooled air is discharged to the indoor through the outlet vent 18 that is formed either on the same surface where the air inlet 12 is formed, namely on the edge of the front surface of the case 10 as shown in FIG. 3(*a*), or on the upper/lower part of the case 10 as shown in FIG. 3(*b*). This process is repeated until indoor air conditioning is sufficient.

However in the related art indoor unit 1 the duct from the air inlet 12 formed at the center of the front surface of the indoor unit 1 en route to the outlet vent 18 via the evaporator coil 16 and the blowing fan 14 is typically in a "U" shape or "L" shape. Therefore, air flow resistance in the duct was great, and because of this, the indoor unit 1 usually generated a lot of noises.

Another problem arises when both the air inlet 12 and the outlet vent 18 are formed on the front surface of the indoor unit as shown in FIG. 3(*a*). In such case, the size or the area of the air inlet 12 is naturally limited by the size of the outlet vent 18. The limitation set on the size or the area of the air inlet 12 also affects the size or the area of the evaporator coil 16. Typically in the indoor unit of the related art air conditioner, the evaporator coil 16 is as big as the air inlet 12, or a little smaller than the air inlet 12.

The limitation set on the size or the area of the air inlet 12 and the evaporator coil 16 is a main factor of the deterioration of work efficiency of the evaporator coil 16 for performing heat exchange between the refrigerant and the indoor air flown into the indoor unit 1.

Moreover, the installation of the indoor unit 1 had to be very careful to place it in a position where air passage can be smooth in the "U" shaped duct from the air inlet 12 to the outlet vent 18, provided that the air inlet 12 and the outlet vent 18 are formed on the same surface.

As shown in FIGS. 3(*a*) and 3(*b*), the air inlet 12 and the outlet vent 18, or the air inlet 12 alone is formed on the front surface of the indoor unit 1. Therefore, it is not easy to engrave a logo or a pattern on the limited space or to coat the front surface of the indoor unit 1 with a unique finishing material on the front surface for the purpose of decoration.

SUMMARY OF THE INVENTION

An object of the invention is to solve at least the above problems and/or disadvantages and to provide at least the advantages described hereinafter.

Accordingly, one object of the present invention is to solve the foregoing problems by providing an air conditioner with a wall-mounted indoor unit, in which air inlets are formed on a bottom surface of the indoor unit and an evaporator coil is installed between the air inlets on the bottom surface and an blowing fan so that air path from the evaporator coil, the blowing fan, to an outlet vent formed on the front surface of the indoor unit is almost straight and as a result, indoor air sucked by the air inlet goes straight to the evaporator coil and is discharged by the outlet vent through the blowing fan and air flow resistance in a duct is considerably reduced.

Another object of the present invention is to provide an air conditioner whose indoor unit can be installed at any position by moving air inlets of the indoor unit from the front surface of the indoor unit to the bottom surface or part of the bottom surface of the indoor unit.

Another object of the invention is to provide an air conditioner having a high heat exchange efficiency at an evaporator coil inside an indoor unit of the air conditioner, by enlarging the area or the size of air inlets formed at the bottom surface of the indoor unit, whereby a greater amount of air can be flown in the indoor unit, promoting the operation of the evaporator coil.

The foregoing and other objects and advantages are realized by providing an air conditioner for operating a refrigeration cycle including compression, condensation, and evaporation is comprised of an indoor unit, the indoor unit including air inlets, an evaporator, a blowing fan, and an outlet vent, wherein an indoor air, being in a discrete state, is sucked in by at least one air inlet, passes through the evaporator and the blowing fan, and eventually discharged from an outlet vent to inside of a defined space.

In an exemplary embodiment, the air inlets are formed on a wall-faced surface of the indoor unit.

In an exemplary embodiment, the indoor unit is fixed on the surface of a wall or separated from the surface of the wall by a predetermined space.

In an exemplary embodiment, number of air inlets and amount of indoor air being sucked are variable in dependence of an installation method of the indoor unit on the wall.

In an exemplary embodiment, height of the evaporator is not less than height of the air inlet.

In an exemplary embodiment, the evaporator is installed in parallel to the blowing fan or tiled at a predetermined angle from the blowing fan.

Another aspect of the invention provides an air conditioner comprised of an indoor unit, the indoor unit including air inlets, an evaporator, a blowing fan, and an outlet vent, wherein the air inlets are formed in an opposite direction of the outlet vent for discharging cooled air; the air inlets are formed on the bottom surface of the indoor unit; indoor air flown into the indoor unit passes through the evaporator and the blowing fan and is discharge from the outlet vent; and air path from the air inlets en route to the outlet vent via the evaporator and the blowing fan is not overlapped.

Still another aspect of the invention provides an air conditioner comprised of an indoor unit, the indoor unit including: a case; air inlets formed on the bottom surface of the case to suck up indoor air; a blowing fan installed inside the case to blow the indoor air from the bottom surface of the case through rotation; an evaporator installed between the air inlets and the blowing fan to generate cooled air through heat change between a refrigerant and the indoor air sucked in the case by an operation of the blowing fan; and an outlet vent for discharging the cooled air that is generated by an operation of the evaporator back to inside of a defined space through the operation of the blowing fan.

As for an air conditioner with a wall-mounted indoor unit according to the present invention, air inlets are formed on a bottom surface of the indoor unit and an evaporator coil is installed between the air inlets on the bottom surface and an blowing fan so that air path from the evaporator coil, the blowing fan, to an outlet vent formed on the front surface of the indoor unit is almost straight and as a result, indoor air sucked by the air inlet goes straight to the evaporator coil and is discharged by the outlet vent through the blowing fan, and air flow resistance in a duct is considerably reduced.

Because air inlets are formed on the bottom surface of the indoor unit, not on the front surface of the indoor unit in the related art, it becomes much easier to install the indoor unit at any place.

By forming the air inlets at the entire bottom surface of the indoor, more space is reserved for the air inlets and for the evaporator so that a greater amount of the indoor air undergoes heat exchange in the evaporator at high exchange efficiency.

Moreover, by forming the air inlets on the entire bottom surface of the indoor unit and by installing an evaporator between the air inlets and a blowing fan, the size of the evaporator can be enlarged and thus, a greater amount of indoor air undergoes heat exchange at high efficiency. This is quite contrary to a related art indoor unit in which the size or area of the evaporator was limited because the air inlets and the outlet vent were formed on the same surface.

Therefore, it is now possible to engrave a logo or a pattern on the limited space or to coat the front surface of the indoor unit with a unique finishing material on the front surface for the purpose of decoration.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present an indoor unit of an air conditioner according to a preferred embodiment of the invention in reference to the accompanying drawings.

Figure 4:
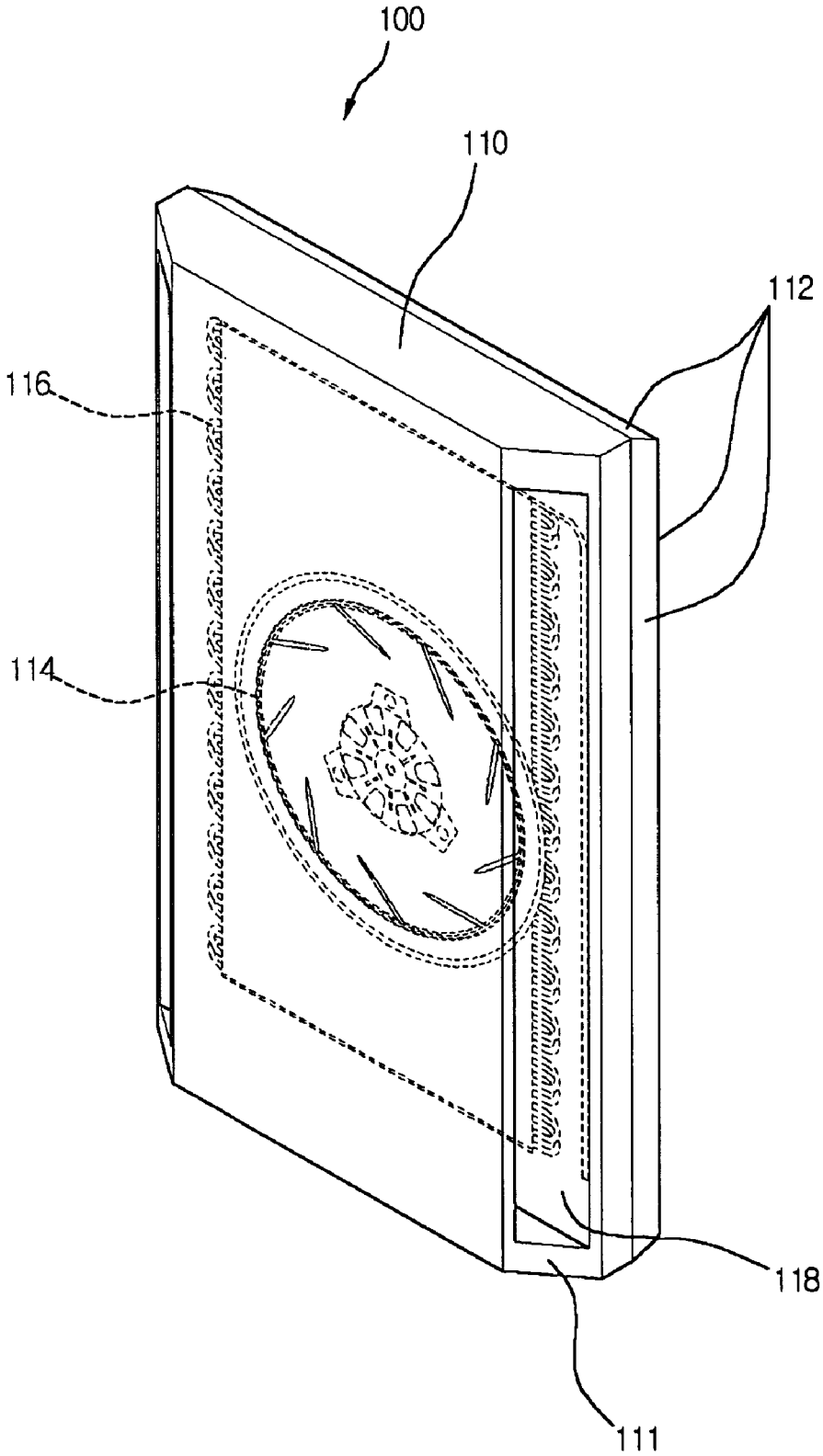
FIG. 4 is a perspective view of an indoor unit of an air conditioner according to a first embodiment of the present invention.
Figure 5A:
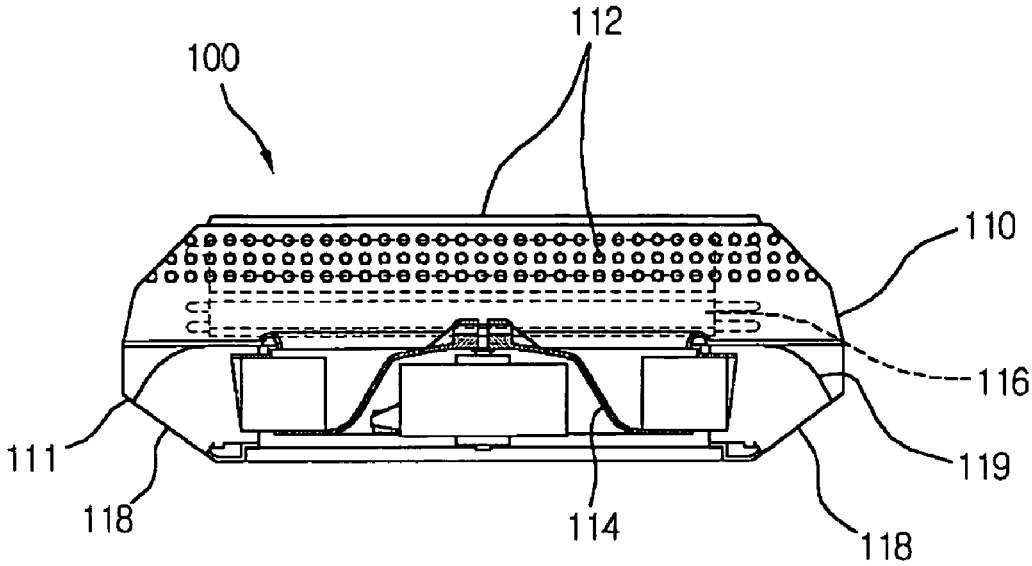
FIG. 5*a* and FIG. 5*b* are front cross-sectional view and plane cross-sectional view of an indoor unit of an air conditioner according to the present invention.
Figure 5B:
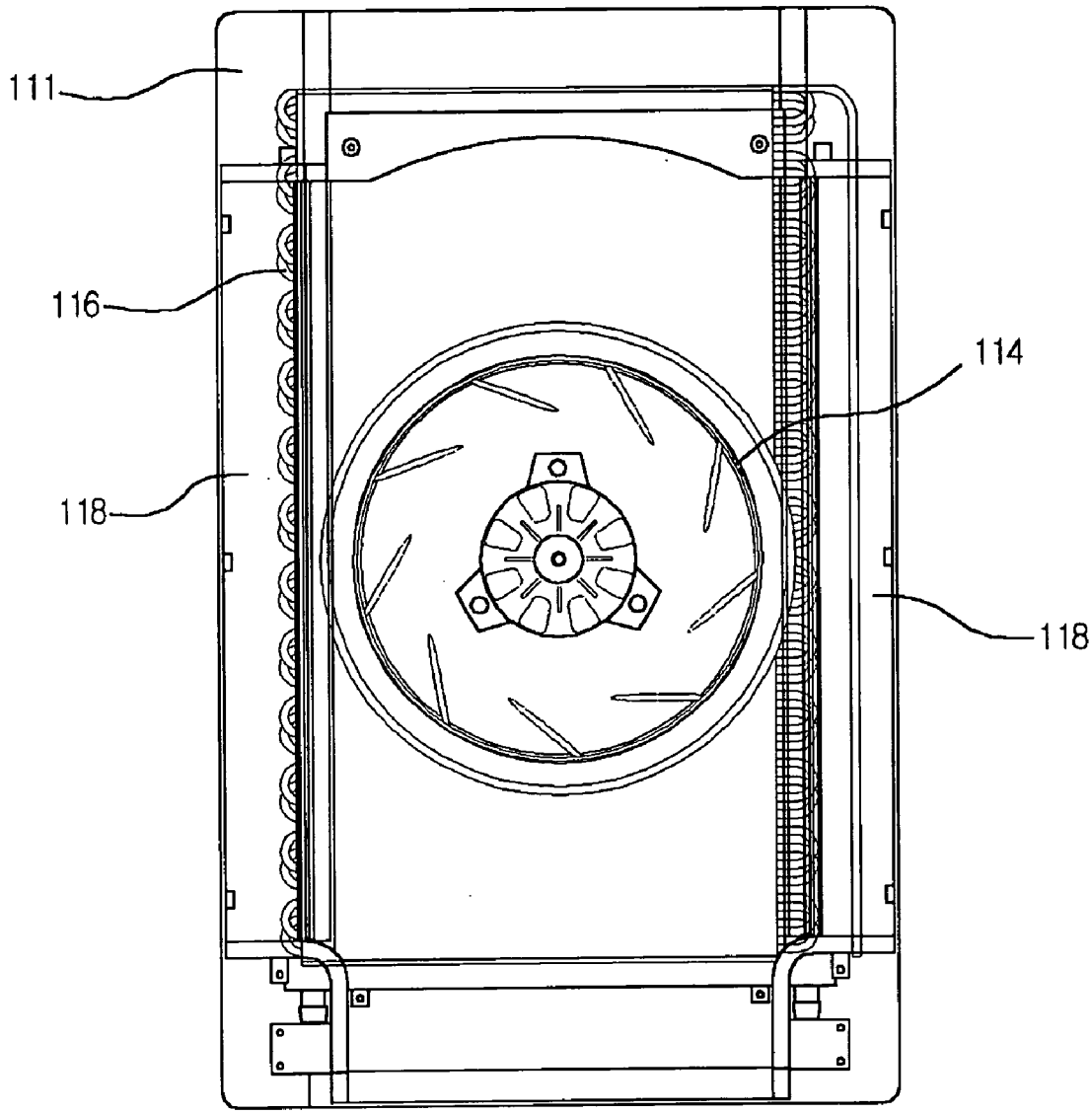
Figure 6A:
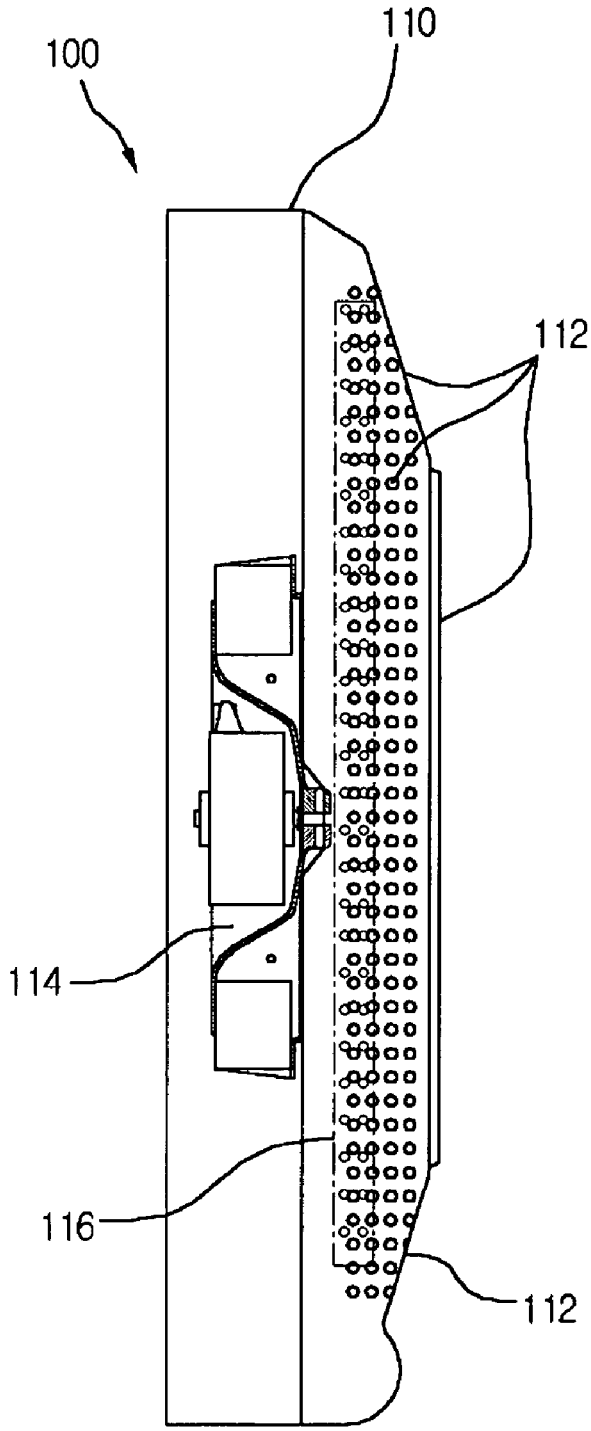
FIG. 6*a* and FIG. 6*b* are side cross-sectional views of an indoor unit of an air conditioner according to the present invention.
Figure 6B:
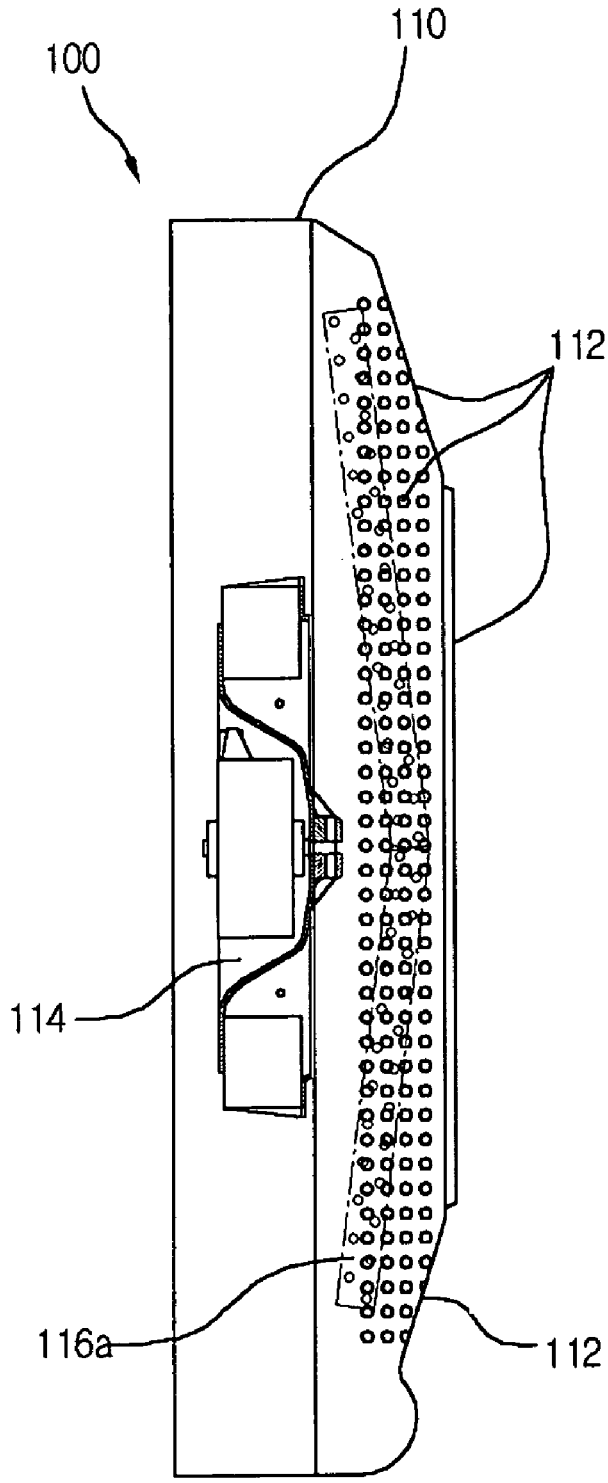
Figure 7:
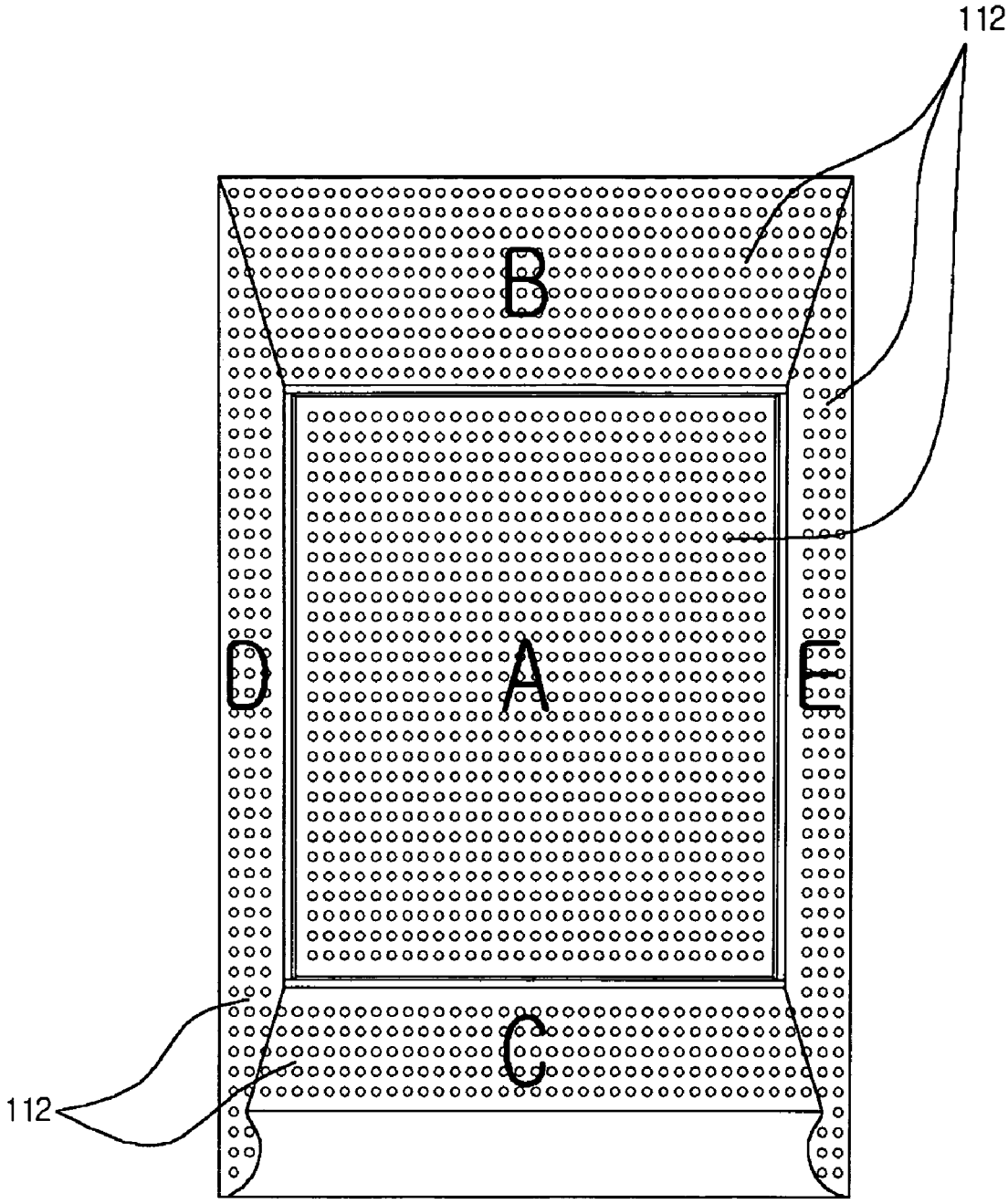
FIG. 7 is a bottom view of an indoor unit of an air conditioner according to the present invention.

FIG. 4 is a perspective view of an indoor unit of an air conditioner according to a first embodiment of the present invention; FIG. 5*a* and FIG. 5*b* are front cross-sectional view and plane cross-sectional view of an indoor unit of an air conditioner according to the present invention; FIG. 6*a* and FIG. 6*b* are side cross-sectional views of an indoor unit of an air conditioner according to the present invention; and FIG. 7 is a bottom view of an indoor unit of an air conditioner according to the present invention.

The indoor unit of an air conditioner according to the present invention includes air inlets 112 formed at the rear surface of the indoor unit that is mounted on the wall or separated by a predetermined distance; a blowing fan 114; an evaporator coil 116 installed between the air inlets 112 and the blowing fan 114; and an outlet vent 118 for discharging a great amount of indoor air sucked by an enlarged area of the air inlet 116 via the evaporator 116 and the blowing fan 114, wherein air path from the air inlet 112, the evaporator 116, the blowing fan 114 and the outlet vent 118 is almost straight.

More details on the structure of the indoor unit will be now described with reference to FIG. 4.

As shown in FIG. 4, air path from the air inlet 112 formed on the bottom surface of the indoor unit 100 to the outlet vent 118 via the evaporator 116 and the blowing fan 114 is straight. Here, the outlet vent 118 is formed on a designated part of the front surface of the indoor unit 100, such as on inclined edges 111 on both sides or non-inclined edges on both sides or upper/lower parts of the indoor unit 100. This straight air path is more effective for reducing air flow resistance than a "U" shaped or "L" shaped air path in a related art indoor unit. Further, by forming the air inlets 112 on the bottom surface of the indoor unit 100, installation of the indoor unit 100 becomes much easier, and more space is reserved for the air inlets 112 and for the evaporator 116 situated between the bottom surface air inlet 112 and the blowing fan 114. In other words, the areas or the sizes of the air inlet 112 and the evaporator 116 are enlarged so that a greater amount of the indoor air is sucked up and used for heat exchange in the evaporator 116.

Figure 1:
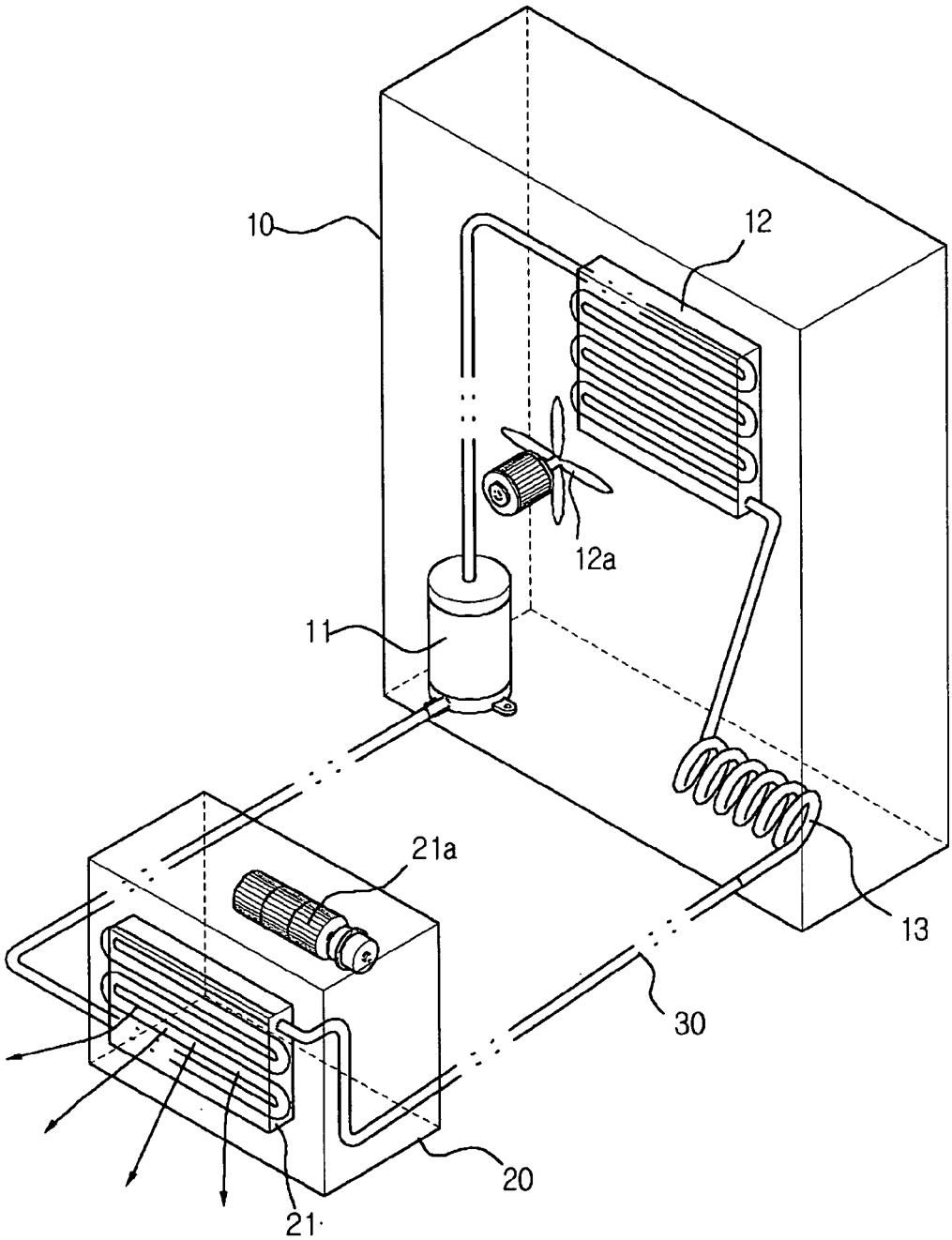
Fig.1 Related Art
FIG. 1 is a schematic diagram of a related art air conditioner.
Figure 2:
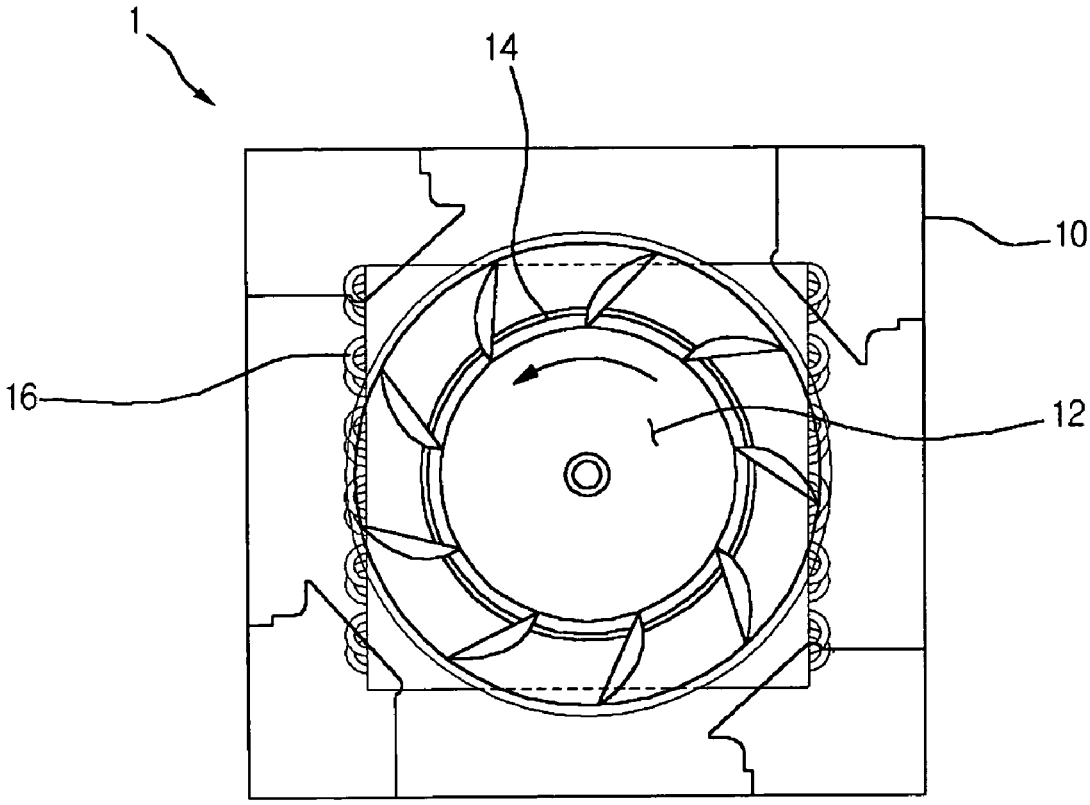
Fig.2 Related Art
FIG. 2 is a front cross-sectional view of a related art indoor unit of an air conditioner.
Figure 3A:
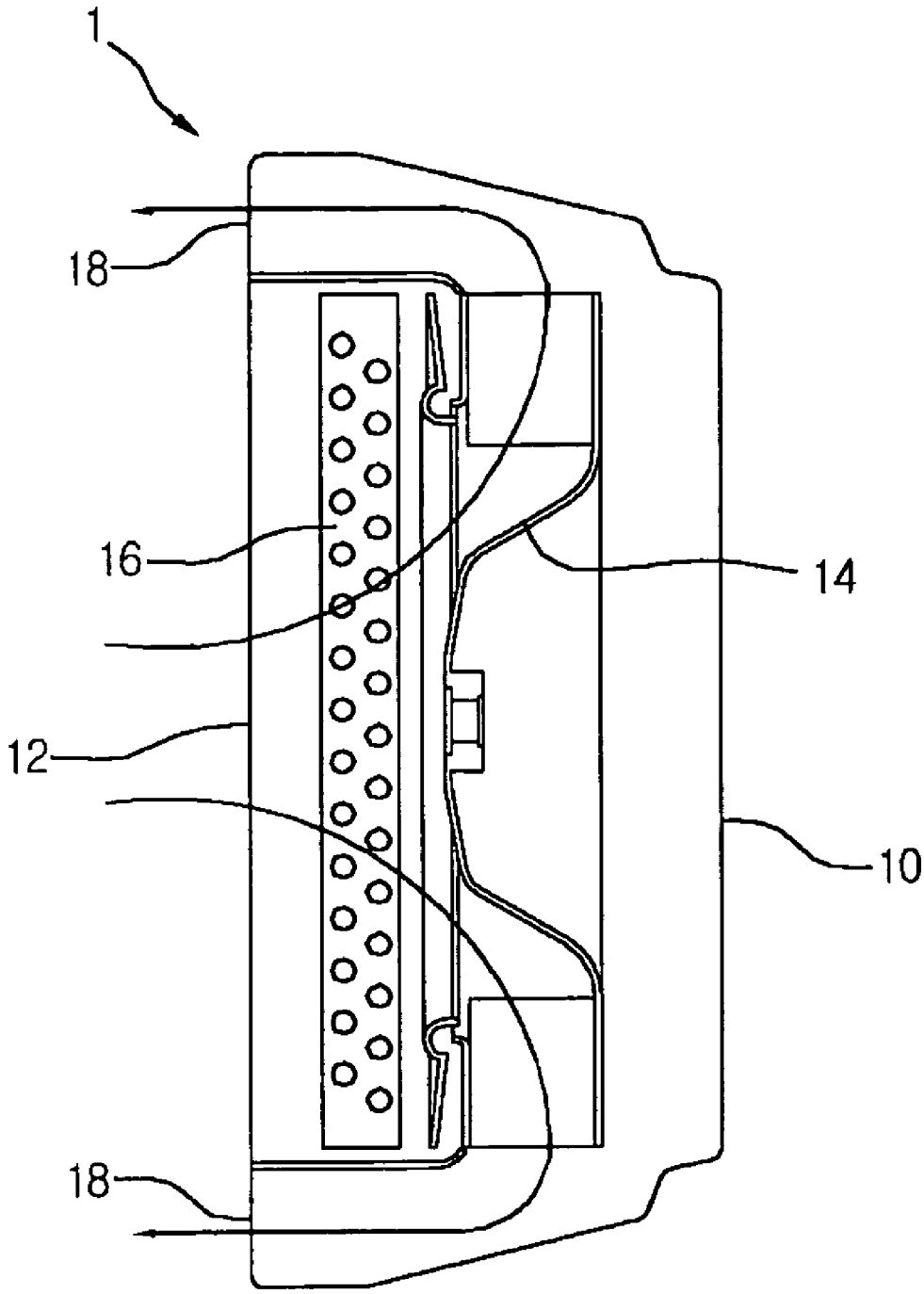
Fig.3A Related Art
FIG. 3*a* and FIG. 3*b* diagrammatically illustrate how a related art indoor unit of an air conditioner works.
Figure 3B:
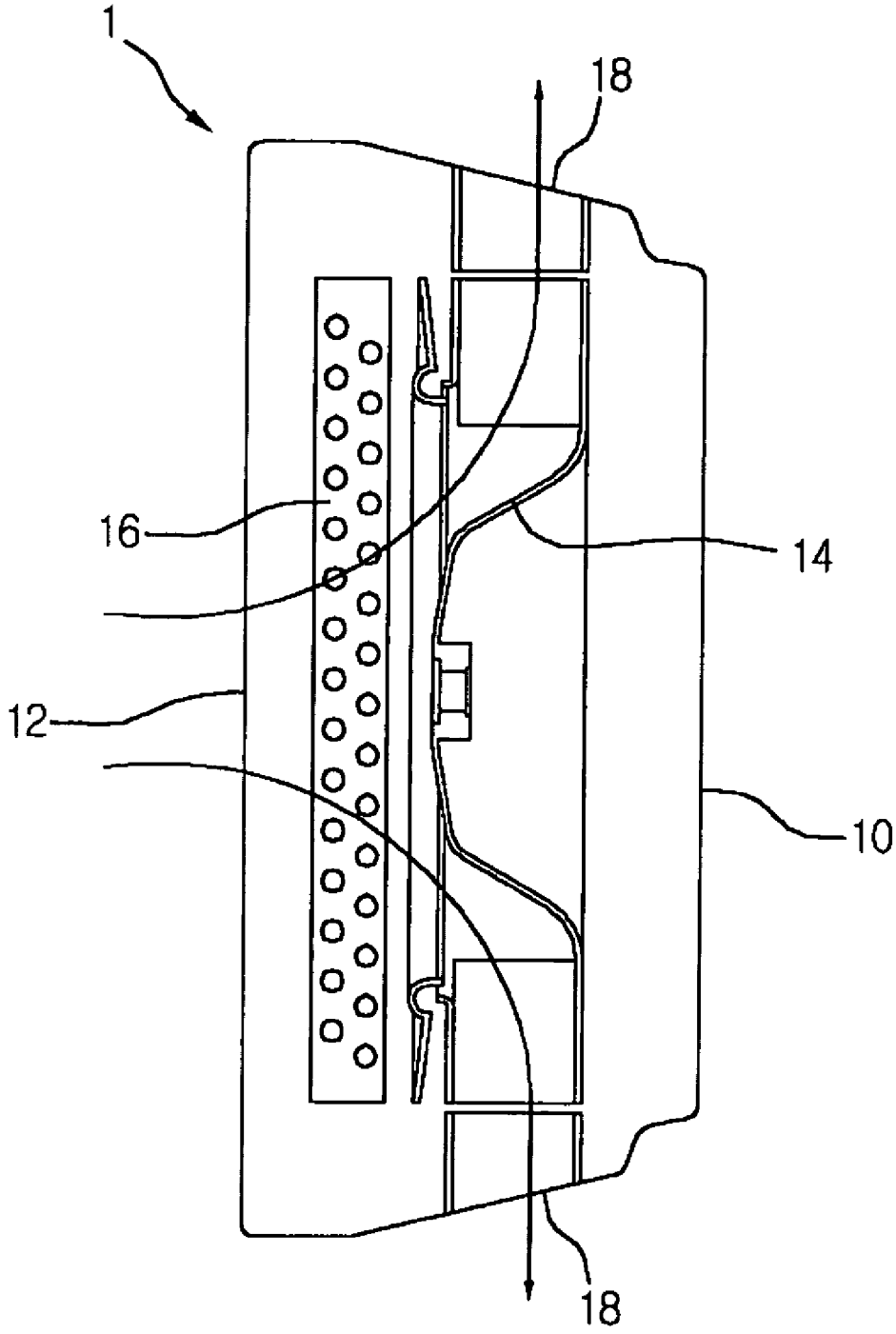
Fig.3B Related Art

Compared to the related art indoor unit 1 of an air conditioner illustrated in FIG. 2, where the air inlets 12 are formed on the front surface of the indoor unit 1, the air inlets 112 of the indoor unit 100 of the present invention are formed on the bottom surface of the indoor unit 100. Thus, a greater amount of the indoor air is sucked up through the air inlet 112 having a larger area than the air inlet 12 of the related art indoor unit 1. Particularly, the evaporator 116 is installed between the air inlets 112 and the blowing fan 114 so that the great amount of the indoor air undergoes heat exchange with a refrigerant inside of the evaporator 116, and generates cooled air.

According to one embodiment of the present invention, the indoor unit 100 of an air conditioner illustrated in FIGS. 4 to 7 includes a case 110; air inlets 112 formed on the bottom surface of the case 110 to suck up the indoor air; a blowing fan 114 installed inside the case 110 to blow the indoor air from the bottom surface of the case 110 through rotation; an evaporator 116 installed between the air inlets 112 and the blowing fan 114 to generate cooled air through heat change between the refrigerant and the indoor air sucked in the case 110 by the operation of the blowing fan 114; and an outlet vent 118 formed on an inclined edge 111 of the front surface of the case 110 to discharge the cooled air generated by the evaporator 116 back to the inside of a defined space by the operation of the blowing fan 114.

As described above, the outlet vent 118 can be formed either on the inclined edges on both sides of the front surface or on the non-inclined (flat) sides. Also, the outlet vent 118 can be formed on the upper/lower parts of the case 110.

Now referring to FIG. 5(*b*) and FIG. 6(*a*), the indoor air sucked in the indoor unit 100 travels from the air inlet 112 formed on the bottom surface of the indoor unit 100, the evaporator 116 and the blowing fan 114 en route to the outlet vent 118 that is formed on the inclined edges 111 of the front surface of the indoor unit 100. The air path is almost straight and thus, has less air flow resistance than that of the "U" shaped or "L" shaped path formed inside the related art indoor unit 1.

As illustrated in FIG. 6(*a*), the evaporator 116 is installed in parallel to the blowing fan 114 or at a tilted angle from the blowing fan 114 in order to enlarge the area for heat change with the indoor air, thereby improving heat change efficiency of the evaporator 116.

Referring to FIG. 7, the air inlets 112 are formed at the center (A) and four edges (B, C, D and E) of the bottom surface of the indoor unit 100, practically covering the entire bottom surface of the indoor unit 100. Especially, the air inlet 112 formed at the center (A) of the bottom surface has a square shape. On the other hand, each of the air inlets 112 formed on the four edges (B, C, D and E) of the bottom surface has a trapezoid shape, being tilted at a certain angle from the center (A) of the bottom surface to the four edges (B, C, D and E) of the bottom surface.

Figure 9A:
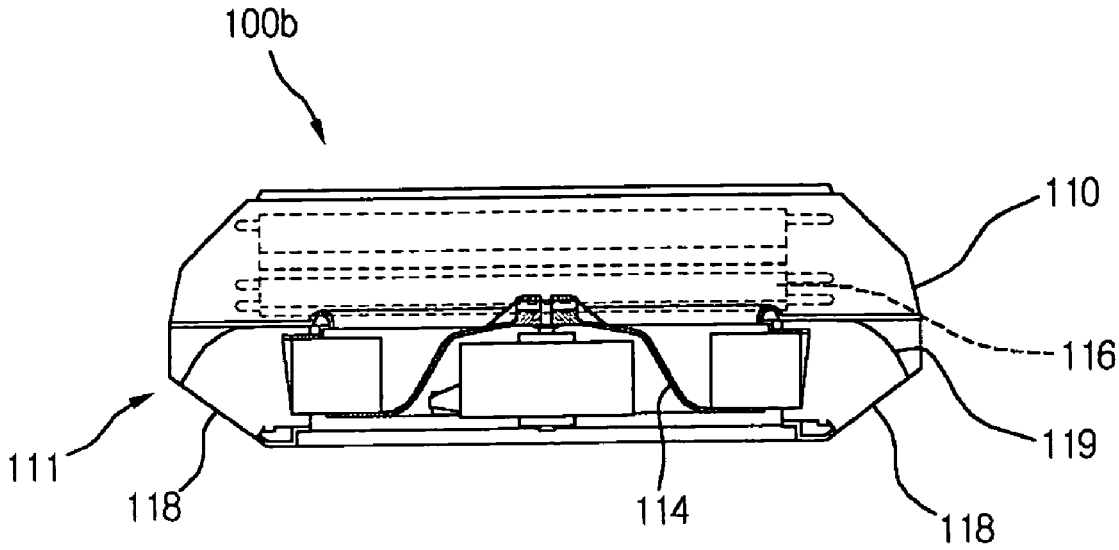
FIGS. 9*a* and 9*b* illustrate an indoor unit of an air conditioner according to a second embodiment of the present invention.
Figure 9B:
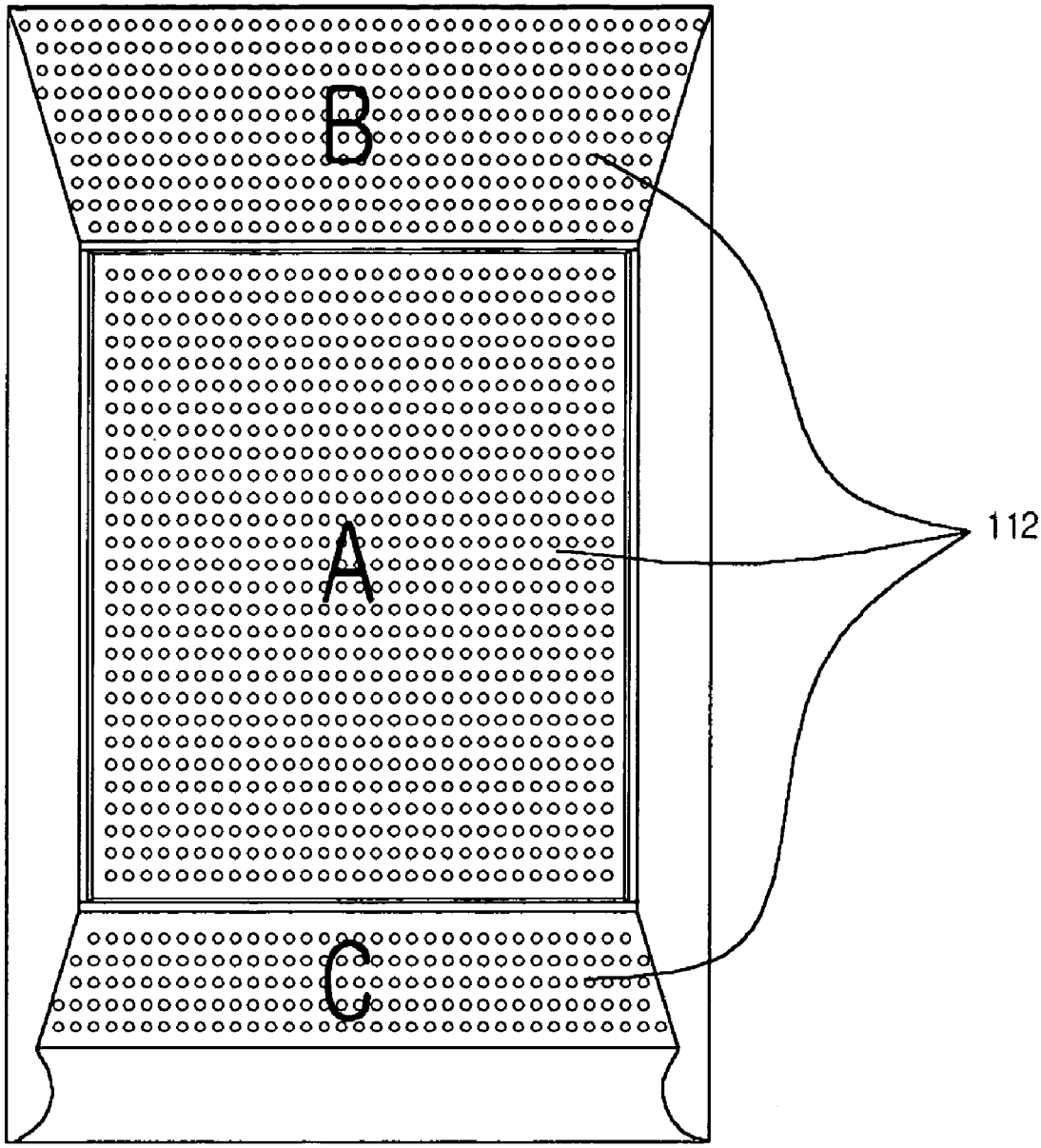

Referring back to FIG. 5, the outlet vents 118 are formed at the inclined edges on both sides of the front surface of the indoor unit 100 to discharge the cooled air having been ventilated along the rotational direction of the blowing fan 114 directly to outside of the indoor unit 100. As shown in FIG. 9(*a*), there is a guide 119 having a designated curvature en route to the outlet vent 118 from the blowing fan 114. The guide 119 ensures that the air directly flows to the outlet vent 118 from the blowing fan 114.

The air inlets 112 are opened or blocked, depending on whether the indoor unit 100 is mounted on the wall, or separated from the wall by a predetermined space and supported by a fixing unit 130. For instance, when the indoor unit 100 is mounted on the surface of the wall as shown in FIG. 8(*a*), the air inlet 112 formed at the center (A) of the bottom surface of the indoor unit 100 shown in FIG. 7 is blocked and only the air inlets 112 formed on the four edges (B, C, D, and E) of the bottom surface of the indoor unit 100 are opened to suck up the indoor air.

On the other hand, when the indoor unit 100 is distant from the wall by a predetermined space and supported by the fixing unit 130, every air inlet 112 formed on the entire bottom surface, namely at the center (A) and four edges (B, C, D, and E), is opened and sucks up a greater amount of the indoor air.

Preferably, the fixing unit 130 is a bracket (not shown) that is strong enough to bear the weight of the indoor unit 100. By using the bracket, a user can place the indoor unit 100 at any desired position on the wall or adjust the height as desired so that air conditioning can be done more effectively.

The operational process of the indoor unit of the air conditioner will now be discussed with reference to related drawings.

Figure 8A:
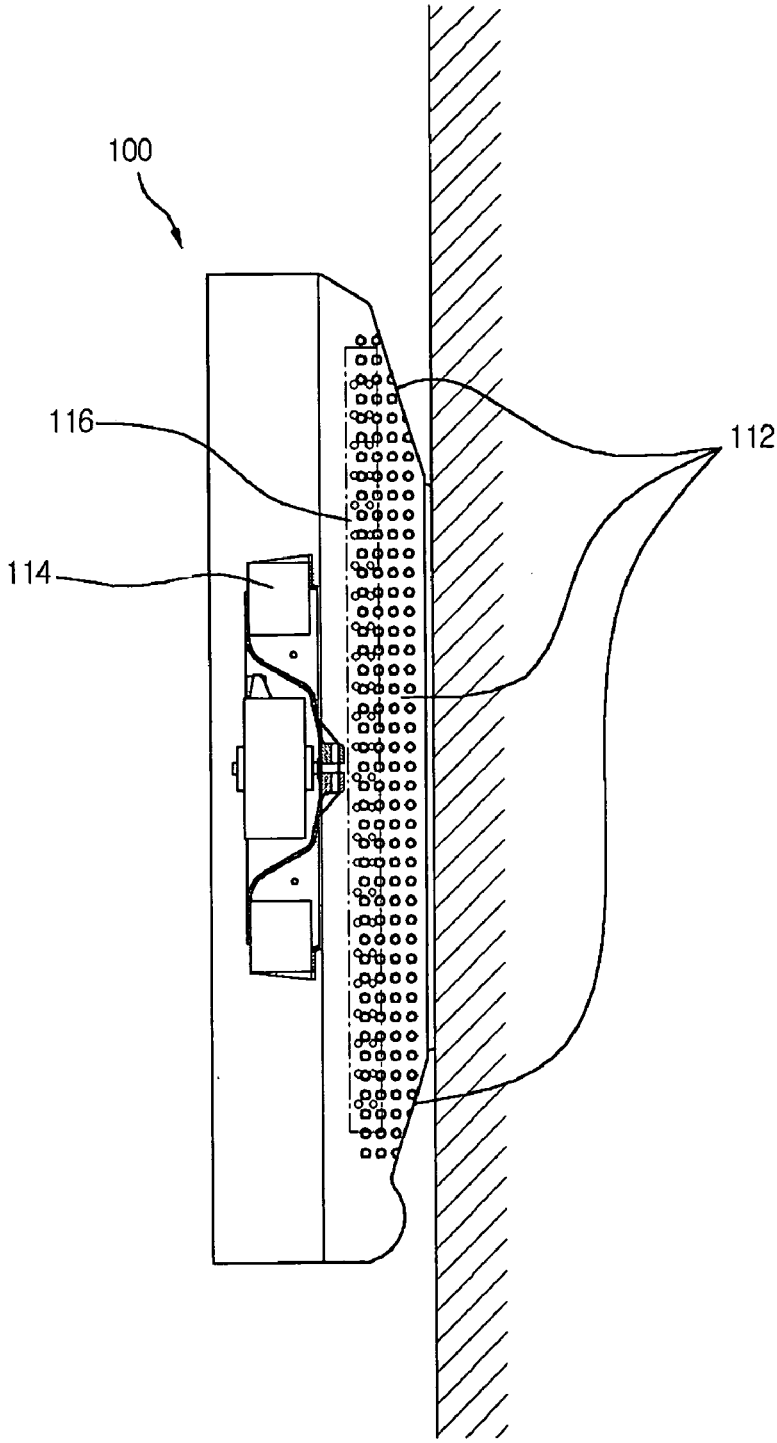
FIG. 8*a* illustrates an operational state of a wall-mounted indoor unit of an air conditioner according to the present invention.
Figure 8B:
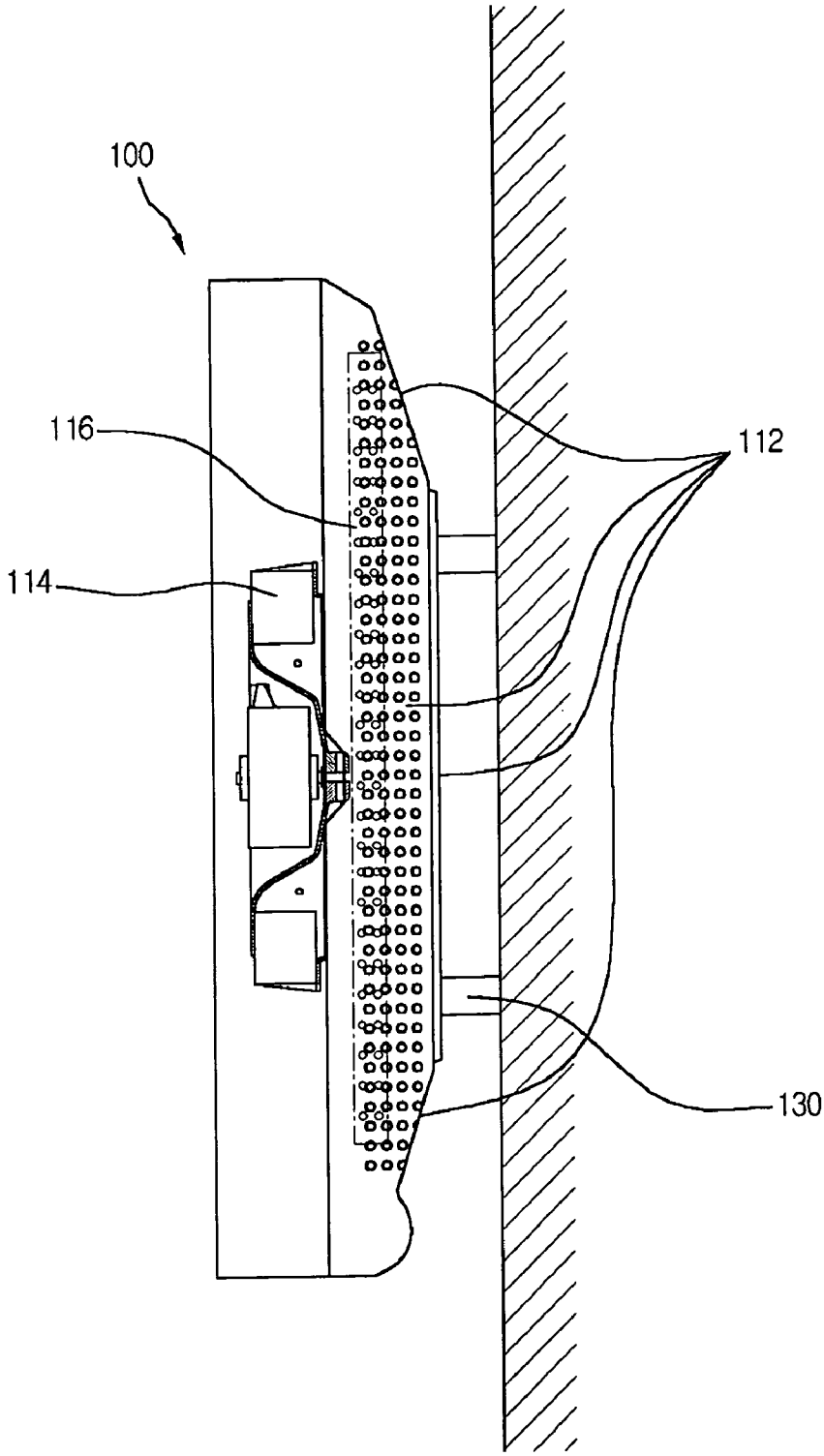
FIG. 8*b* illustrates an operational state of an indoor unit of an air conditioner according to the present invention, in which the indoor unit is separated from a wall by means of a fixing unit.

FIGS. 8(*a*) and 8(*b*) illustrates operational states of the air conditioner mounted on the wall. More specifically, FIG. 8*a* illustrates an operational state of the wall-mounted indoor unit of the air conditioner according to the present invention; and FIG. 8*b* illustrates an operational state of the indoor unit of the air conditioner according to the present invention, in which the indoor unit is separated from the wall by means of a fixing unit.

First, when the indoor unit 100 is mounted on the surface of the wall as shown in FIG. 8(*a*), low-temperature, low-pressure liquefied refrigerant from an outdoor unit (not shown) flows in the evaporator 116 that is situated between the air inlets 112 formed on the bottom surface of the indoor unit 100 and the blowing fan 114, and meets the indoor air that has been sucked in through the air inlets formed on the four edges of the bottom surface (in this case, the air inlet formed at the center of the bottom surface is blocked) by the operation of the blowing fan 114. As described above, since the indoor unit 100 is mounted on the surface of the wall, the air inlet 112 formed at the center of the bottom surface of the indoor unit 100 is blocked, and only the air inlets 112 formed at the four edges (B, C, D, and E) of the bottom surface of the indoor unit 100 are opened to suck up the indoor air into the indoor unit 100. The indoor air then travels inside the pipe of the evaporator 116 and is cooled down through heat exchange with the refrigerant. As shown in FIG. 5, by the operation of the blowing fan 114 the cooled air is discharged to inside of a defined space through the outlet vent 118 formed on the inclined edges 111 on the front part of the case 110, and as a result, indoor air conditioning is performed.

Meanwhile, when the indoor unit 100 is separated from the wall by a predetermined space and supported through the fixing unit 130, low-temperature, low-pressure liquefied refrigerant from an outdoor unit (not shown) flows in the evaporator 116 that is situated between the air inlets 112 formed on the bottom surface of the indoor unit 100 and the blowing fan 114, and meets the indoor air that has been sucked in through the air inlets formed at the center (A) of the bottom surface of the indoor unit 100 and on the four edges of the bottom surface by the operation of the blowing fan 114. In this case, the indoor unit 100 is separated from the wall by a predetermined space so that all air inlets 112 formed at the center (A) and four edges (B, C, D, and E) of the bottom surface of the indoor unit 100 are opened to suck up the indoor air into the indoor unit 100. The indoor air then travels inside the pipe of the evaporator 116 and is cooled down through heat exchange with the refrigerant. Again as shown in FIG. 5, by the operation of the blowing fan 114 the cooled air is discharged to inside of a defined space through the outlet vent 118 formed on the inclined edges 111 on the front part of the case 110, and as a result, indoor air conditioning is performed.

FIGS. 9(*a*) and 9(*b*) illustrate an indoor unit 100*a* of an air conditioner according to a second embodiment of the present invention. As shown in FIG. 9, the indoor unit 100*a* includes a case 110; air inlets 112 formed on upper/lower edges (B and C) and at the center (A) of the bottom surface of the case 110 to suck up the indoor air; a blowing fan 114 installed inside the case 110 to blow the indoor air from the bottom surface of the case 110 through rotation; an evaporator 116 installed between the air inlets 112 and the blowing fan 114 to generate cooled air through heat change between the refrigerant and the indoor air sucked in the case 110 by the operation of the blowing fan 114; and an outlet vent 118 formed on an inclined edge 111 of the front surface of the case 110 to discharge the cooled air generated by the evaporator 116 back to the inside of a defined space by the operation of the blowing fan 114.

Figure 10A:
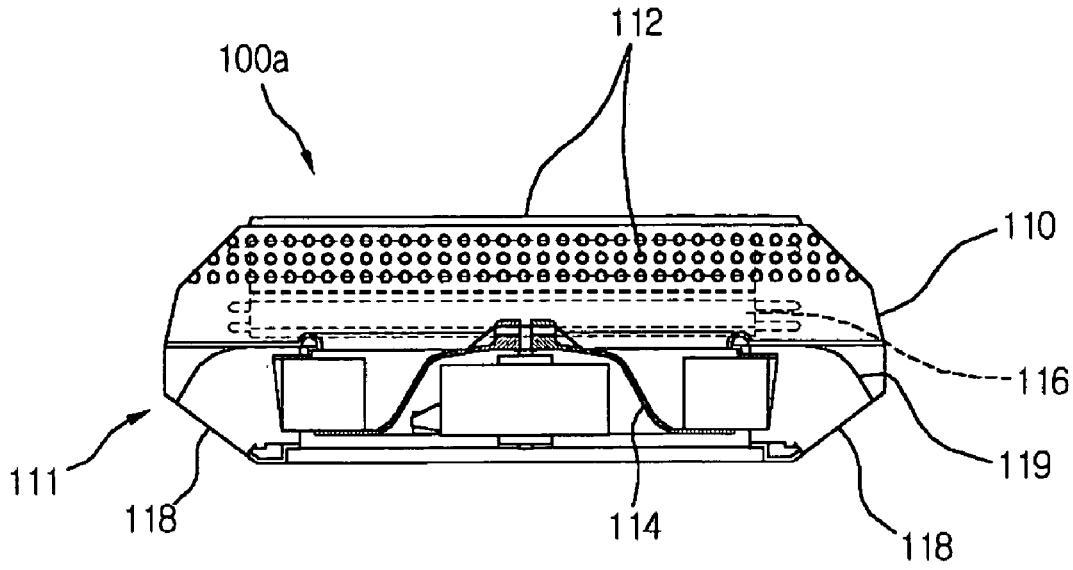
FIGS. 10*a* and 10*b* illustrate an indoor unit of an air conditioner according to a third embodiment of the present invention.
Figure 10B:
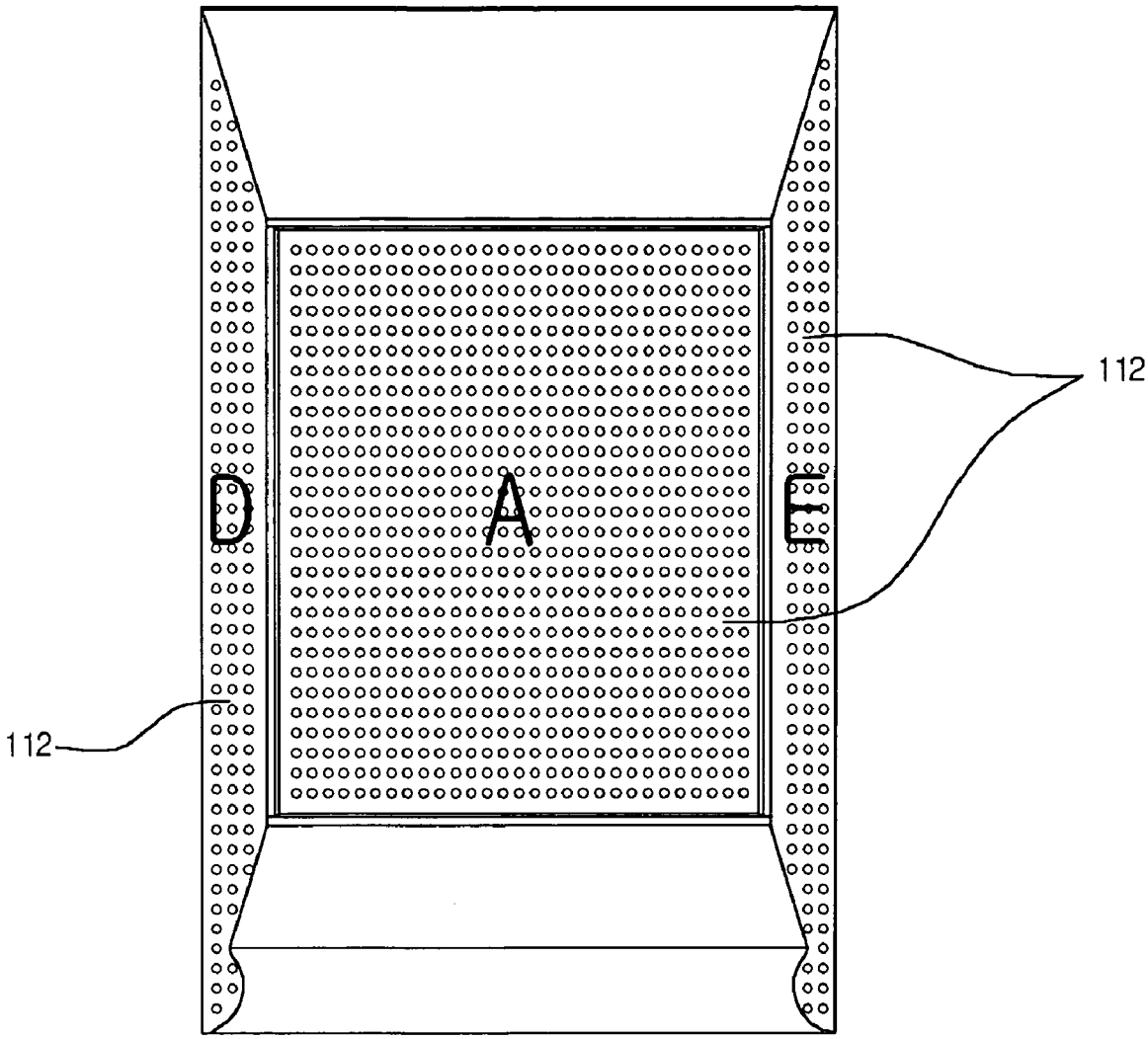

FIGS. 10(*a*) and 10(*b*) illustrate an indoor unit 100*b* of an air conditioner according to a third embodiment of the present invention. As shown in FIG. 10, the indoor unit 100*b* includes a case 110; air inlets 112 formed on right/left edges (D and E) and at the center (A) of the bottom surface of the case 110 to suck up the indoor air; a blowing fan 114 installed inside the case 110 to blow the indoor air from the bottom surface of the case 110 through rotation; an evaporator 116 installed between the air inlets 112 and the blowing fan 114 to generate cooled air through heat change between the refrigerant and the indoor air sucked in the case 110 by the operation of the blowing fan 114; and an outlet vent 118 formed on an inclined edge 111 of the front surface of the case 110 to discharge the cooled air generated by the evaporator 116 back to the inside of a defined space by the operation of the blowing fan 114.

Figure 11A:
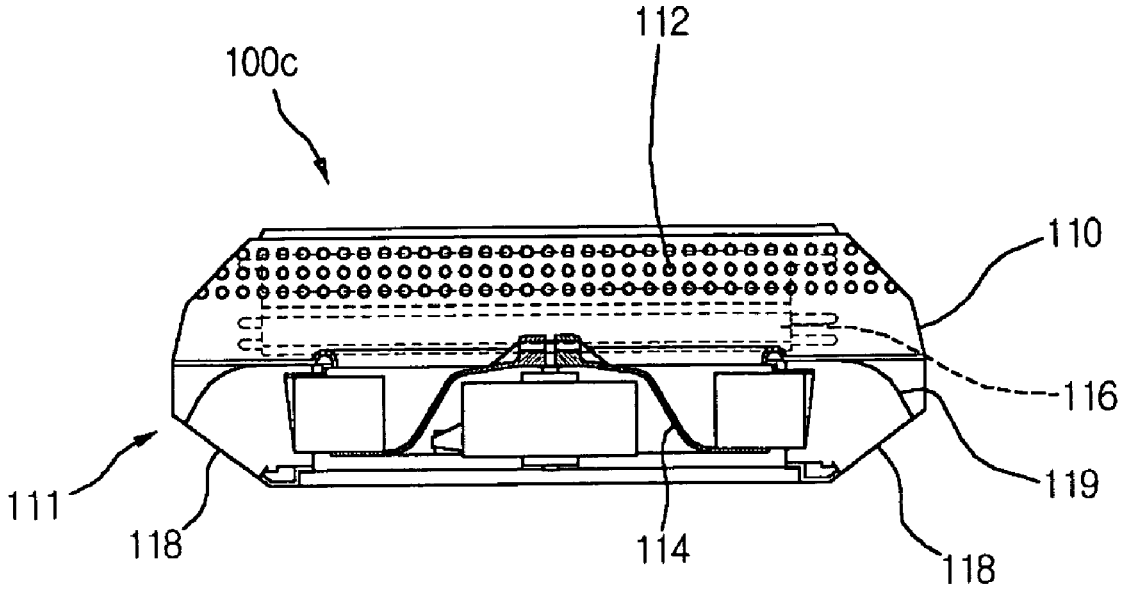
FIGS. 11*a* and 11*b* illustrate an indoor unit of an air conditioner according to a fourth embodiment of the present invention.
Figure 11B:
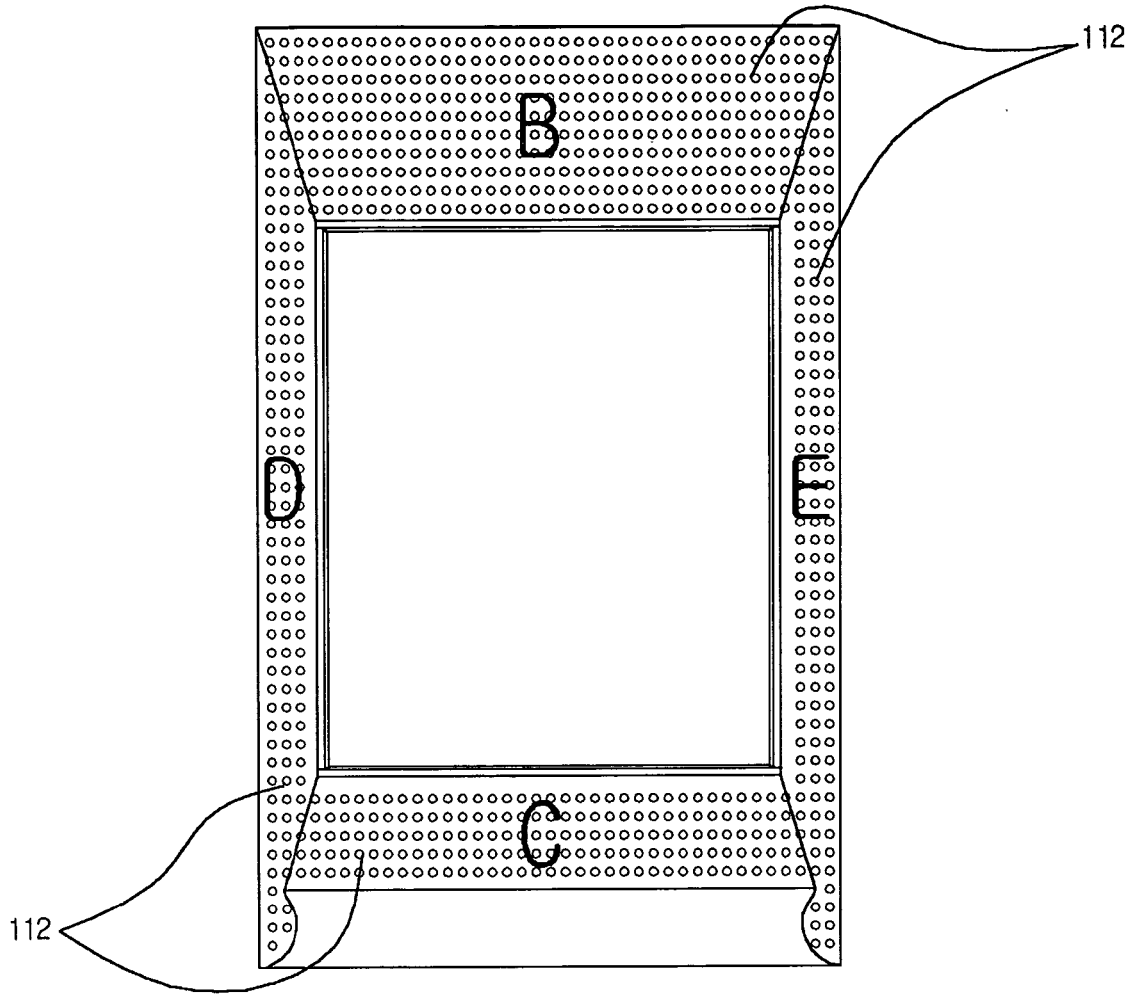

FIGS. 11(*a*) and 11(*b*) illustrate an indoor unit 100*c* of an air conditioner according to a second embodiment of the present invention. As shown in FIG. 11, the indoor unit 100*c* includes a case 110; air inlets 112 formed on four edges (B, C, D and E) and center (A) of the bottom surface of the case 110 to suck up the indoor air; a blowing fan 114 installed inside the case 110 to blow the indoor air from the bottom surface of the case 110 through rotation; an evaporator 116 installed between the air inlets 112 and the blowing fan 114 to generate cooled air through heat change between the refrigerant and the indoor air sucked in the case 110 by the operation of the blowing fan 114; and an outlet vent 118 formed on an inclined edge 111 of the front surface of the case 110 to discharge the cooled air generated by the evaporator 116 back to the inside of a defined space by the operation of the blowing fan 114.

Figure 12A:
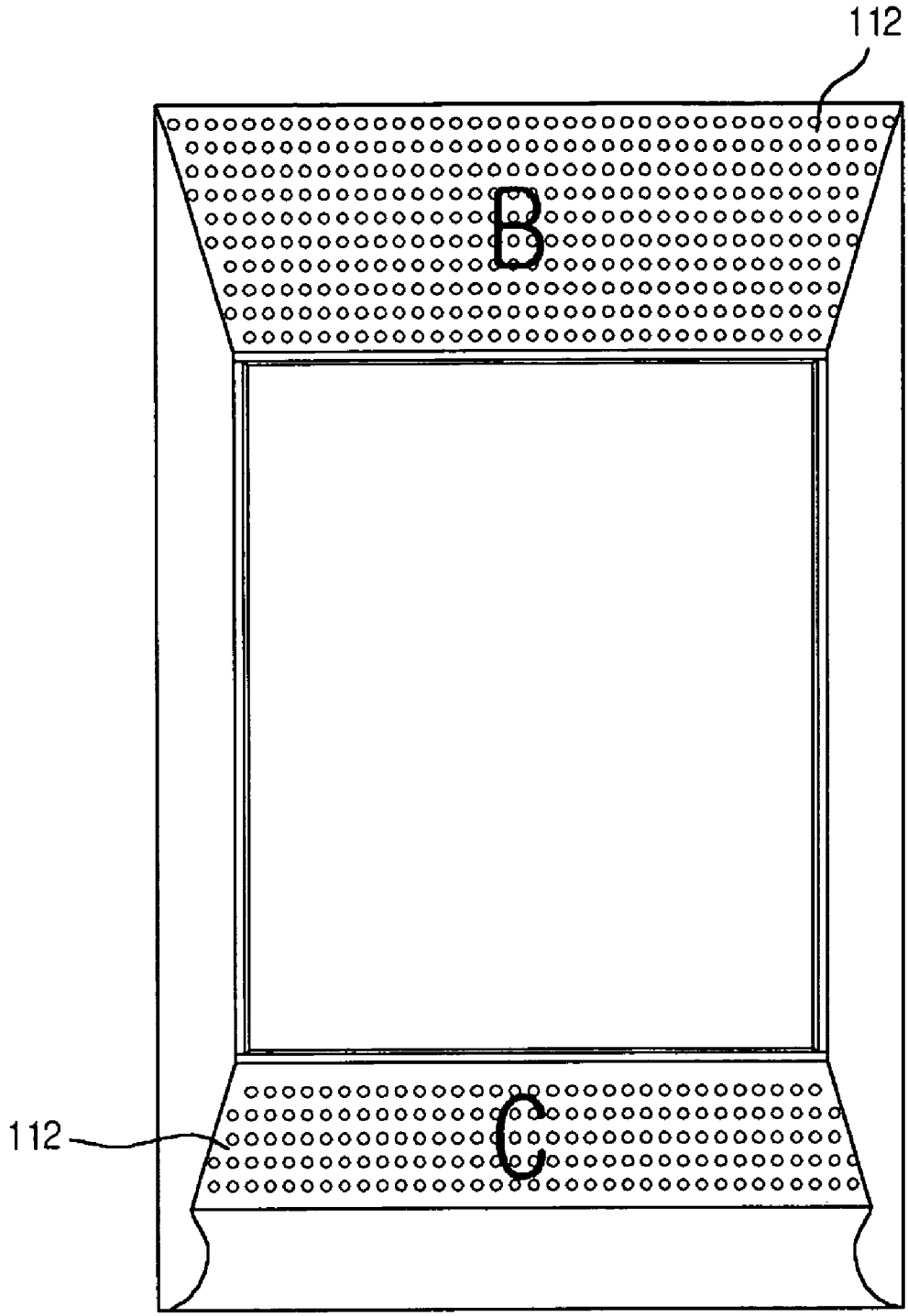
FIGS. 12*a*, 12*b*, and 12*c* respectively illustrate an indoor unit of an air conditioner according to a fifth, sixth, and seventh embodiment of the present invention.
Figure 12B:
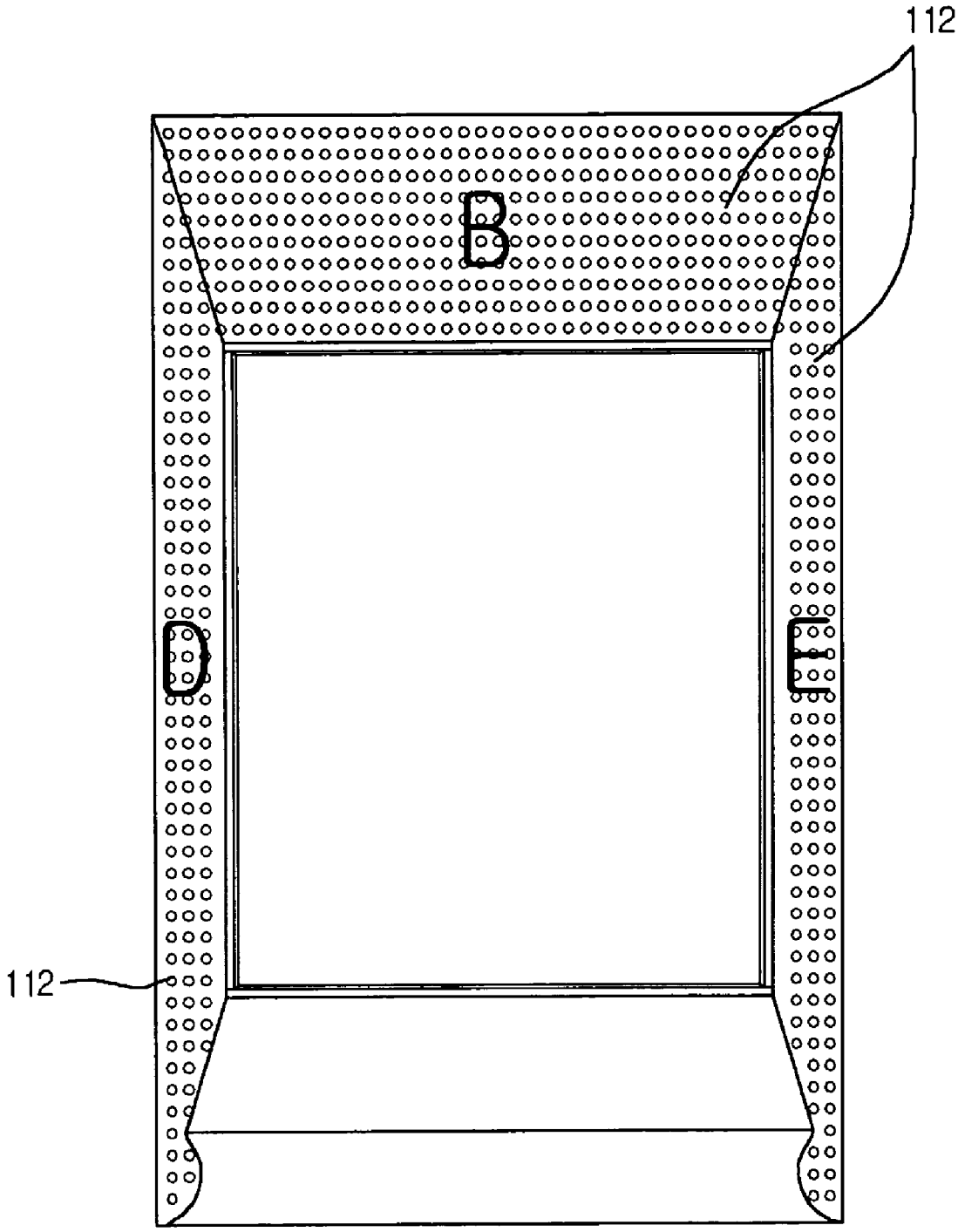
Figure 12C:
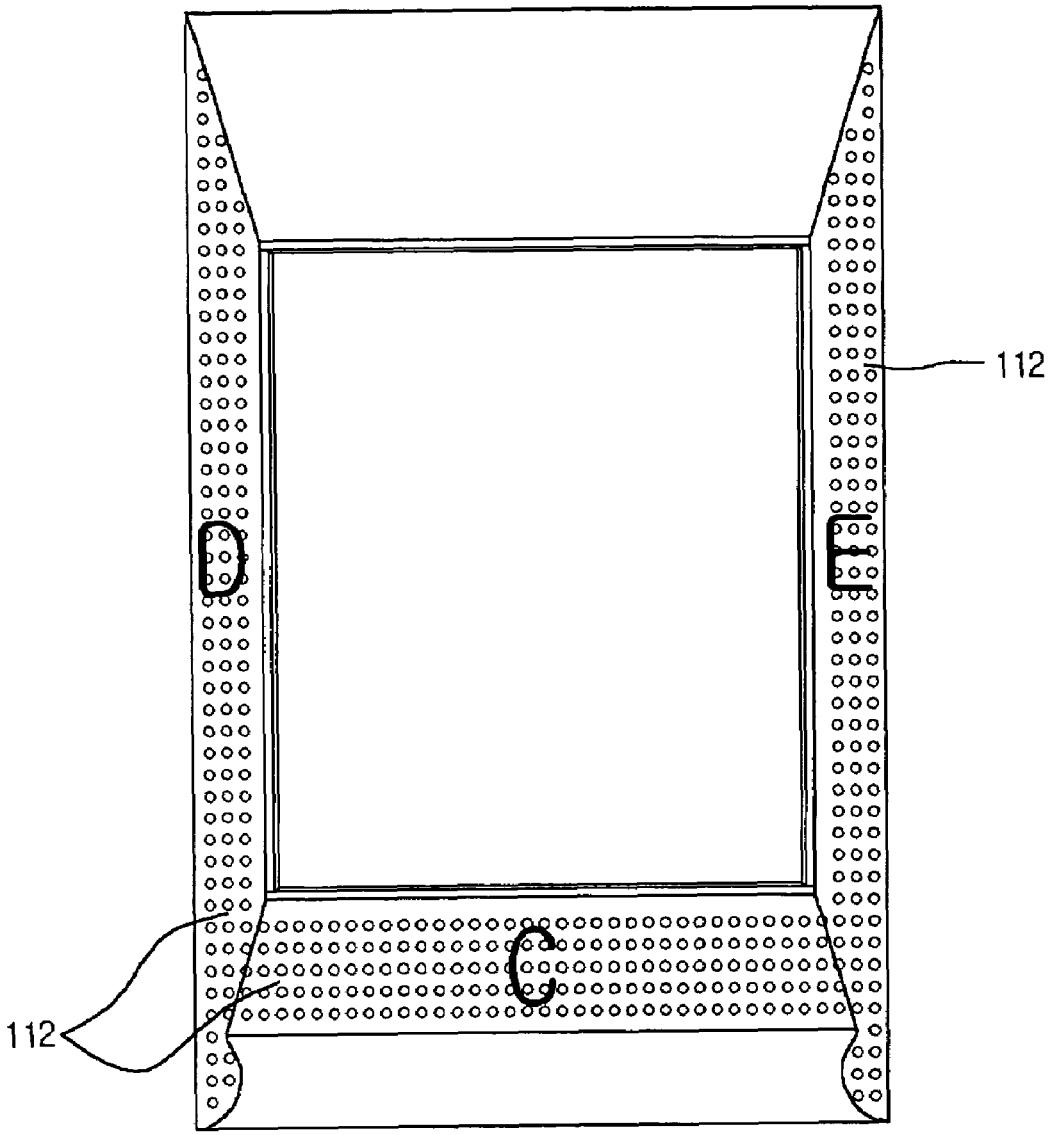

FIGS. 12*a*, 12*b*, and 12*c* respectively illustrate air inlets inside an indoor unit of an air conditioner according to a fifth, sixth, and seventh embodiment of the present invention.

More specifically, FIG. 12(*a*) illustrates that the air inlets are formed on the upper (B) and lower (C) parts of the bottom surface of a case; FIG. 12(*a*) illustrates that the air inlets are formed on the upper (B) part and on both sides (D and E) of the bottom surface of a case; and FIG. 12(*c*) illustrates that the air inlets are formed on the lower part (C) and on both sides (D and E) of the bottom surface of a case.

As shown in FIGS. 4 to 12, the blowing fan 114 is installed inside the indoor unit 100 to suck and to blow a greater amount of the indoor air flown into the indoor unit 100 through the air inlets 112. Therefore, more than one blowing fan 114 can be installed at both shafts of a fan motor.

In conclusion, the indoor unit 100 of the air conditioner according to the present invention is effective for reducing air flow resistance that is typically observed in the "U" shape or "L" shape air path in the related art indoor unit 1, by making the almost straight air path from the air inlets 112 formed on the bottom surface of the indoor unit 100, the evaporator 116, the blowing fan 114 en route to the outlet vent 118. Also, by forming the air inlet 112 on the bottom surface of the indoor unit 100, installation of the indoor unit 100 becomes much easier, and more space is reserved for the air inlet 112 and for the evaporator 116 so that a greater amount of the indoor air undergoes heat exchange in the evaporator 116 at high exchange efficiency.

While the invention has been shown and described with reference to certain preferred embodiments thereof, it will be understood by those skilled in the art that various changes in form and details may be made therein without departing from the spirit and scope of the invention as defined by the appended claims.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An air conditioner that operates according to a refrigeration cycle comprising compression, condensation, and evaporation, the air conditioner comprising:

an indoor unit, the indoor unit comprising air inlets, an evaporator, a blowing fan, and an outlet vent, wherein indoor air, not being in a overlapped state in view of a predetermined plane, is sucked in by at least one air inlet, passes through the evaporator and the blowing fan, and is eventually discharged from an outlet vent to inside of a defined space, wherein the air inlets are provided on a wall facing surface of the indoor unit.

2. The air conditioner according to claim 1, wherein the indoor unit is fixed on the surface of a wall.

3. The air conditioner according to claim 1, wherein the indoor unit is separated from the surface of the wall by a predetermined space.

4. The air conditioner according to claim 1, wherein a number of air inlets and an amount of indoor air being sucked are variable in dependence upon an installation method of the indoor unit on the wall.

5. The air conditioner according to claim 1, wherein a height of the evaporator is not less than a height of the air inlet.

6. The air conditioner according to claim 5, wherein the evaporator is installed in parallel to the blowing fan or tilted at a predetermined angle with respect to the blowing fan.

7. An air conditioner comprising an indoor unit, the indoor unit comprising air inlets, an evaporator, a blowing fan, and an outlet vent, wherein the air inlets are provided in an opposite direction of the outlet vent for discharging cooled air; the air inlets are provided on a bottom surface of the indoor unit; indoor air blown into the indoor unit passes through the evaporator and the blowing fan and is discharge from the outlet vent; and an air path from the air inlets towards the outlet vent via the evaporator and the blowing fan is not overlapped.

8. An air conditioner including an indoor unit, the indoor unit comprising:

a case;

air inlets formed at upper/lower parts and center of a bottom surface of the indoor unit, and configured to suck up indoor air;

a blowing fan installed inside the case and that rotates to blow the indoor air from the bottom surface of the case;

an evaporator installed between the air inlets and the blowing fan to generate cooled air through heat exchange between a refrigerant and the indoor air sucked in the case by operation of the blowing fan; and an outlet vent for discharging the cooled air that is generated by an operation of the evaporator back to an inside of a defined space through the operation of the blowing fan.

9. An air conditioner including an indoor unit, the indoor unit comprising:

a case;

air inlets formed at four edges of a bottom surface of the indoor unit to suck up indoor air;

a blowing fan installed inside the case and that rotates to blow the indoor air from the bottom surface of the case;

an evaporator positioned between the air inlets and the blowing fan to generate cooled air through heat exchange between a refrigerant and the indoor air sucked in the case by operation of the blowing fan; and an outlet vent for discharging the cooled air that is generated by an operation of the evaporator back to an inside of a defined space through the operation of the blowing fan.

10. The air conditioner according to claim 9, wherein the air inlets, formed at the four edges of the bottom surface of the indoor unit, are tilted at a predetermined angle from a central surface.

11. The air conditioner according to claim 7, wherein if the indoor unit is mounted on the surface of a wall and the bottom surface of the case faces the wall, air inlets formed at the center of the bottom surface are blocked by the wall so that the indoor air is sucked into the indoor unit through a plurality of air inlets formed at four edges of the bottom surface of the case.

12. The air conditioner according to claim 7, wherein if the indoor unit is spaced from the surface of a wall and the bottom surface of the case faces the wall, the indoor air is sucked into the indoor unit through a plurality of air inlets formed at the center and four edges of the bottom surface of the case.

13. The air conditioner according to claim 12, wherein the indoor unit is spaced from the surface of the wall by a predetermined space and supported by a fixing unit to be vertically translated.

14. The air conditioner according to claim 7, wherein at least one blowing fan is installed inside the indoor unit to blow a greater amount of the indoor air that is sucked in through the air inlet into the indoor unit.

15. The air conditioner according to claim 7, wherein at least one outlet vent is formed at both sides of the front surface of the indoor unit to be harmonized with a rotational direction of the blowing fan.

16. The air conditioner according to claim 15, wherein a guide is provided between the blowing fan and the outlet vent to ensure that air from the blowing fan is guided directly to the outlet vent and discharged therethrough.

* * * * *